US005405128A

United States Patent [19]

Fujiwara et al.

[11] Patent Number: 5,405,128

[45] Date of Patent: Apr. 11, 1995

[54] SHEET FEED DEVICE FOR AN IMAGE FORMING APPARATUS

[75] Inventors: Hiroshi Fujiwara, Tokyo; Kunio Hibi, Yokohama; Katsumi Kurihara, Tokyo; Hiroshi Tanabe; Masanori Matsuda, both of Yokohama; Takahiro Shinga, Tsuchiura; Satoshi Takanashi, Chigasaki, all of Japan

[73] Assignee: Ricoh Company, Ltd., Tokyo, Japan

[21] Appl. No.: 100,314

[22] Filed: Aug. 2, 1993

[30] Foreign Application Priority Data

| | | | |
|---|---|---|---|
| Jul. 31, 1992 | [JP] | Japan | 4-205702 |
| Aug. 4, 1992 | [JP] | Japan | 4-208109 |
| Jan. 14, 1993 | [JP] | Japan | 5-005043 |

[51] Int. Cl.[6] ..... B65H 3/44

[52] U.S. Cl. ..... 271/9; 271/164; 271/167

[58] Field of Search ..... 271/9, 162, 164, 167

[56] References Cited

U.S. PATENT DOCUMENTS

| | | | |
|---|---|---|---|
| 5,102,112 | 4/1992 | Takahashi | 271/9 |
| 5,195,734 | 3/1993 | Tanabe | 271/9 |
| 5,221,951 | 6/1993 | Sakamoto | 271/9 |
| 5,259,606 | 11/1993 | Takahashi | 271/9 |

FOREIGN PATENT DOCUMENTS

| | | | |
|---|---|---|---|
| 2-204237 | 8/1990 | Japan | 271/9 |
| 3-147645 | 6/1991 | Japan | 271/9 |

*Primary Examiner*—H. Grant Skaggs
*Assistant Examiner*—Carol L. Druzbick
*Attorney, Agent, or Firm*—Oblon, Spivak, McClelland, Maier & Neustadt

[57] ABSTRACT

A highly reliable sheet feed device for a copier, facsimile apparatus, printer or similar image forming apparatus and having a plurality of sheet storing portions which are arranged substantially horizontally and serially in an intended direction of sheet transport. The device surely feeds sheets from the storing portions one by one and eliminate sheet jams and defective sheet feed. Further, the device is simple and miniature and capable of accommodating a plurality of kinds of sheets therein.

11 Claims, 13 Drawing Sheets

SHEET FEED DEVICE FOR AN IMAGE FORMING APPARATUS

BACKGROUND OF THE INVENTION

The present invention relates to a copier, facsimile apparatus or similar image forming apparatus and, more particularly, to a sheet feed device for such an image forming apparatus and having a plurality of substantially horizontal sheet feed portions arranged serially in an intended direction of sheet transport.

It has been customary with a family of image forming apparatuses mentioned above to mount a plurality of cassettes on the apparatus body for accommodating sheets of different sizes and different kinds. A front loading type sheet feed device, or sheet feeder, is spreading in which trays are arranged one above the other in multiple stages for a space saving purpose. The problem with the conventional front loading type sheet feeder is that since each sheet feed stage is loaded with a single kind of sheets, trays assigned to sheets of small sizes, e.g., A4 and B5 are of the same size as trays assigned to sheets of large sizes, e.g., A3 and B4. As a result, the sheet feeder is bulky. Moreover, since the height of such a sheet feeder is limited to promote easy manipulation, the number of sheets which can be accommodated in the sheet feeder is limited.

In the light of this, the sheet feed stages may include one having two sheet storing portions each being loaded with sheets of particular size, as disclosed in Japanese Patent Laid-Open Publication No. 204237/1990 by way of example. Alternatively, use may be made of a cassette capable of storing two kinds of sheets and provided with feeding means at opposite sides thereof with respect to a direction of sheet feed, as taught in, e.g., Japanese Patent Laid-Open Publication No. 192032/1991. These schemes each use either a sheet feed stage or a cassette for feeding two kinds of sheets in order to reduce the number of sheet feed stages or the number of cassettes. However, each of the two storing portions constituting the sheet feed stage or the cassette has respective transport path extending to an image forming section, as in the plural sheet feed stage scheme or the plural cassette scheme. In such a configuration, the transport paths need an additional space and, therefore, increase the overall size of the sheet feeder. In addition, the double path configuration specializes and complicates the sheet feeder.

There has been proposed a sheet feeder including a sheet feed stage having two sheet storing portions which are capable of storing sheets of two small sizes. In this sheet feeder, the sheets are selectively fed out from the two sheet storing portions. This is successful in effectively using the space heretofore wasted, inclusive of the transport paths, and, in increasing the capacity of the sheet feeder. To adapt the sheet feeder to the front loading arrangement as well, the two sheet storing portions are arranged serially in the direction of sheet feed, and each is provided with respective sheet feeding and separating means. A sheet paid out from the rear storing portion is transported to the sheet feeding and separating means associated with the front storing portion. As a result, the sheets from the two storing portions are fed out over a common path. However, since the sheets from both of the two storing portions arrive at the sheet feeding and separating means adjoining the front storing portion, a problem particular to this kind of sheet feeder arises. Specifically, the sheets from the two storing portions are apt to overlap at the sheet feeding and separating means or to jam the path terminating thereat.

SUMMARY OF THE INVENTION

It is therefore an object of the present invention to provide a highly reliable sheet feed device for an image forming apparatus which eliminates jams and defective sheet feed by surely feeding sheets from adjoining sheet storing portions one by one.

It is another object of the present invention to provide a sheet feed device for an image forming apparatus which is simple and small size and can accommodate a plurality of kinds of sheets.

In accordance with the present invention, a sheet feed device comprises a plurality of storing portions arranged serially in an intended direction of sheet transport, and each being loaded with a stack of sheets, a separating section located downstream, in the intended direction of sheet transport, of a feeding section associated with the most downstream one of the plurality of storing portions for separating the sheets fed from storing portions, and a transporting section for transporting the sheets fed by a feeding section associated with upstream one of the storing portions to the separating section.

Also, in accordance with the present invention, a sheet feed device comprises a plurality of storing portions constituted by a plurality of sheet feed stages arranged one above the other, the sheet feed stages each comprising two storing portions arranged serially in an intended direction of sheet transport, a feeding section provided at one end of each of the storing portions with respect to the intended direction of sheet transport for paying out sheets from the storing portion, the feeding section including a separating section for separating the sheets one by one, a common transport path connected to the sheet feed stages for transporting sheets selectively paid out from the storing portions in the same direction to a predetermined position downstream of the common transport path with respect to the intended direction of sheet transport, and a plurality of transport paths each being associated with respective one of the sheet feed stages for transporting sheets paid out from the two storing portions of the sheet feed stage.

Further, in accordance with the present invention, a sheet feed device comprises a first storing portion positioned substantially horizontally, a first sheet feeding and separating section for paying out sheets from the first storing portion while separating them one by one, and including a returning section for returning a needless sheet in a direction opposite to an intended direction of sheet pay-out, a substantially horizontal second storing portion serially adjoining and located at the rear of the first storing portion with respect to the intended direction of sheet pay-out, a second sheet feeding and separating section for paying out sheets from the second storing portion one by one in the same direction as the intended direction of pay-out, and a transporting section for guiding the sheets paid out from the second sheet feeding and separating section to the first sheet feeding and separating section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
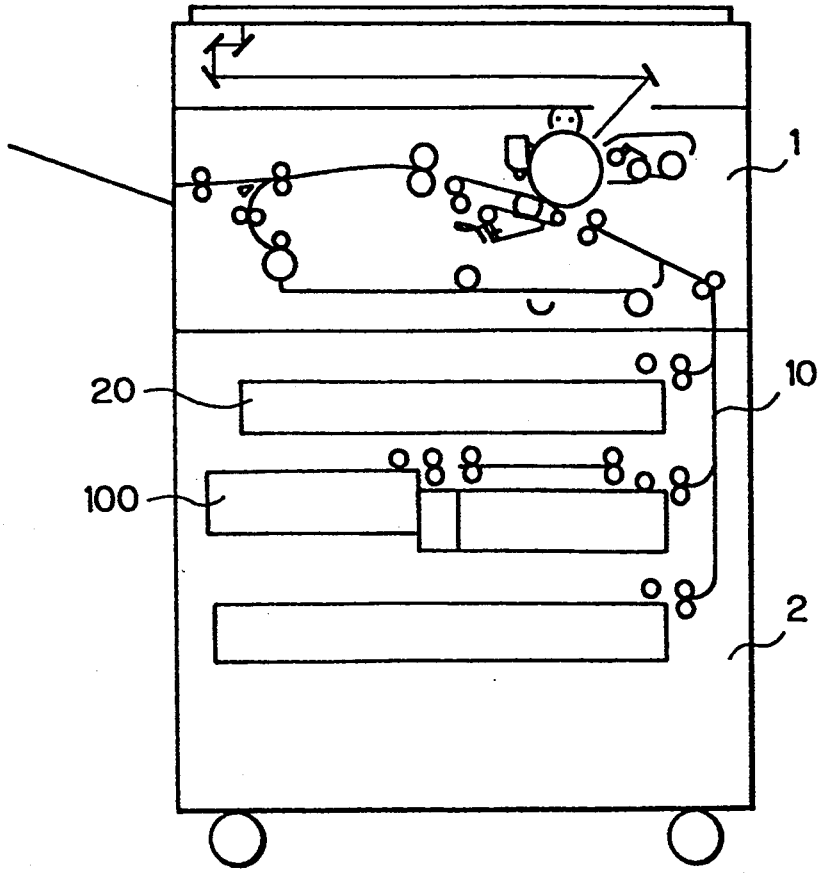
FIG. 1 is a view of a copier to which a first embodiment of the sheet feed device in accordance with the present invention is applied.

Referring to FIG. 1 of the drawings, a copier implemented with a sheet feed device embodying the present invention is shown. As shown, the copier has a body 1 housing an arrangement for image formation. A front loading type sheet feed section, or sheet feeder, 2 has a plurality of trays arranged one above the other and each storing sheets of particular size. A pick-up and separation device is located at the right end of each tray, as viewed in the figure. A transport path 10 extends vertically to guide a sheet fed from any one of the trays to the image forming section of the copier body 1. Let this transport path be referred to as a vertical transport path hereinafter. Each tray can be pulled out substantially perpendicularly to the direction in which the sheets are fed out from the tray, so that the supplement of sheets, for example, may be performed. Specifically, the sheet feeder 2 has an uppermost tray (first sheet feed stage) 20 capable of accommodating 250 to 500 sheets of A3, B4 or similar comparatively large size. A sheet feed device (second sheet feed stage) 100 embodying the present invention is disposed below the tray 20 and accommodates sheets of two comparatively small sizes, e.g., A4 and B5 in individual stacks. The sheet feed device 100 will be described hereinafter specifically.

Figure 2A:
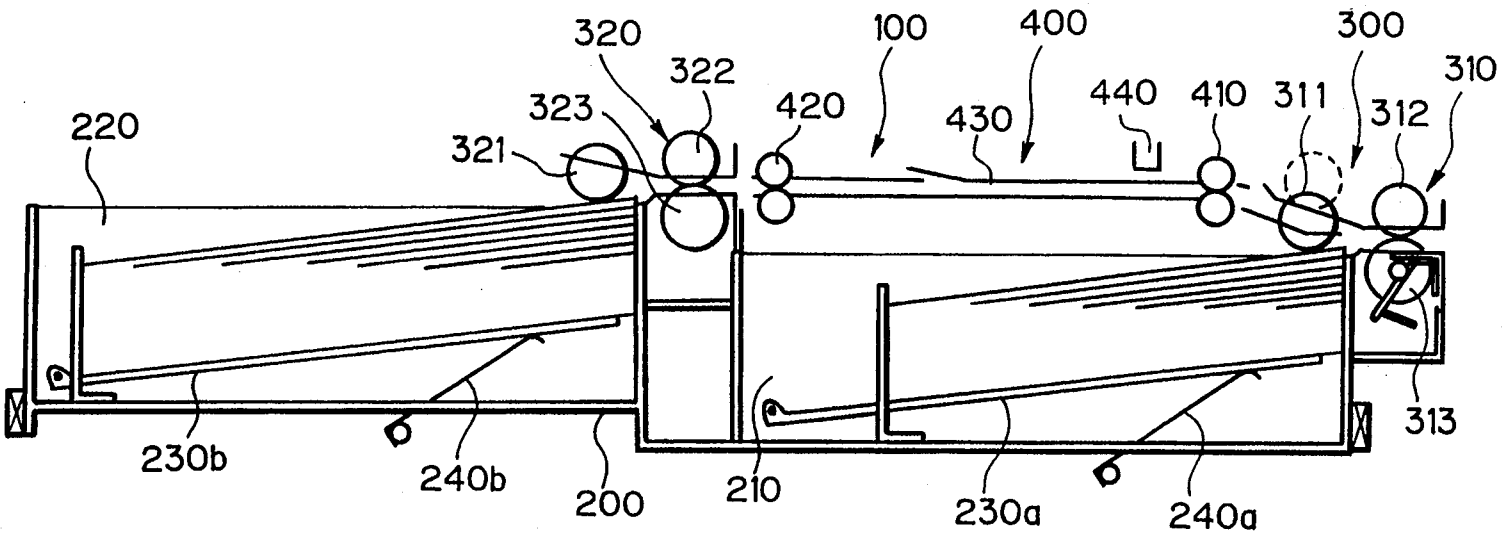
FIGS. 2A and 2B are sections showing the sheet feed device embodying the present invention.

As shown in FIG. 2A, the sheet feed device 100 has a tray 200 provided with two sheet storing portions 210 and 220 adjoining each other serially in the direction of sheet feed. Sheet feeding and separating means 300 is associated with each of the sheet storing portions 210 and 220 to pay out the sheets one by one. A transport device 400 drives the sheet paid out from the rear storing portion 220 of the tray 200 to the vertical transport path 10, FIG. 1. In the following description, the right storing portion 210 close to the vertical transport path 10 and the left storing portion 220 remote from the path 10 will be referred to as a first and a second storing portion, respectively.

The sheet feeding and separating means 300 pays out the uppermost sheet from associated one of the first and second storing portions 210 and 220 toward the vertical transport path 10, i.e., to the right as viewed in FIG. 2A. Therefore, while the first and second sheet storing portions 210 and 220 are arranged side by side in the right-and-left direction as viewed from the operator's side, the second portion 220 is positioned behind the first portion 210 with respect to the direction of sheet feed. In this sense, the tray 200 is a so-called tandem tray.

The first storing portion 210 is capable of accommodating 250 to 500 sheets of comparatively small size, e.g., A4 or B5 in the lateral orientation with respect to the direction of sheet feed. The second storing portion 220 is capable of storing 250 to 500 sheets of comparatively small size also in the lateral orientation. However, the sheets stacked in the second storing portion 220 may be different or identical in size or kind from or with the sheets of the first storing section 210. Since the first and second storing portions 210 and 220 both store sheets of small size in the lateral orientation with respect to the direction of sheet feed, the overall size of the tray 200 is substantially the same as that of the tray 20 storing sheets of large size, as measured in the widthwise direction.

The first and second storing sections 210 and 220 include a first and a second bottom plate **230*a* and 230*b*, respectively. The bottom plates 230*a* and 230*b* are each rotatable to press the sheets stacked thereon against the sheet feeding and separating means 300. As shown in FIG. 2A, the storing portions 210 and 220 are different in level from each other, i.e., the bottom plate 230*b* of the storing portion 220 is higher than the bottom plate 230*a* of the storing portion 210. Hence, when the maximum allowable number of sheets are stacked on each of the bottom plates 230*a* and 230*b*, the top of the stack of the storing portion 220 is higher than the top of the stack of the storing portion 210. Alternatively, the bottom plate 230*b* may be positioned at the same level as the bottom plate 230*a* if the storing portion 220 is configured to accommodate a greater number of sheets than the storing portion 210. In any case, the front end of the tray 200 is constituted by a side panel or an ornamental panel of uniform height. This allows the operator to handle the tray 200 as an ordinary tray without noticing the difference in level between the two storing portions 210 and 220. An extra space is available above the storing portion 210 due to the difference in level between the storing portions 210 and 220. Part of the rear end of the tray 200 corresponding to the storing portion 210 is notched such that it is lower in level than the storing portion 220**.

Figure 2B:
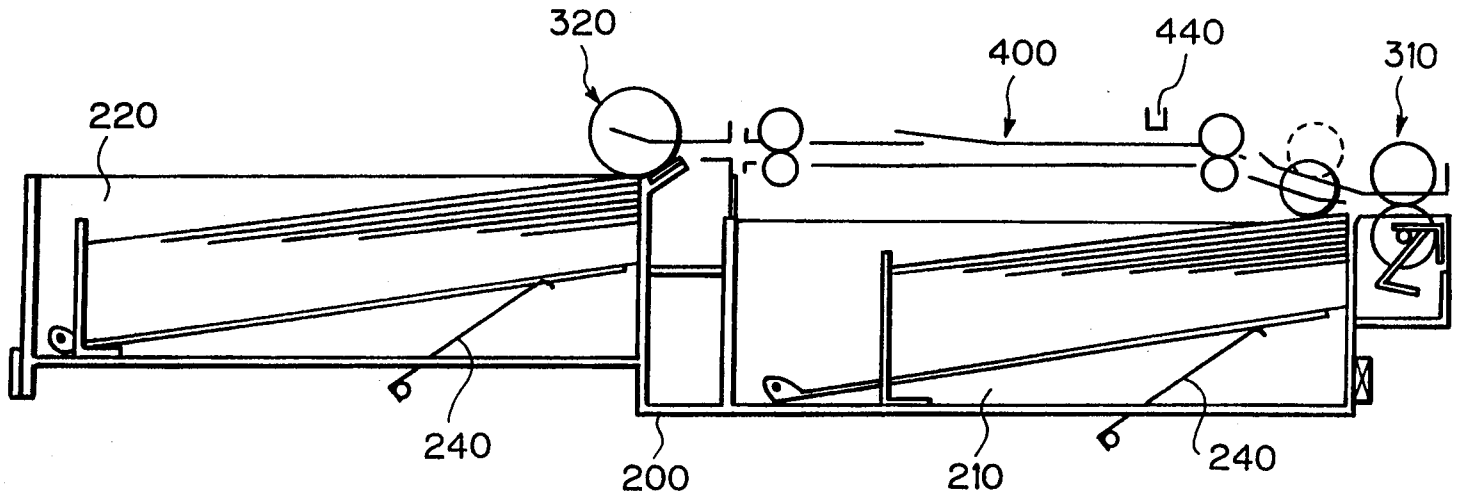

The sheet feeding and separating means 300 are implemented as sheet feed and separation devices 310 and 320 associated with the first and second storing portions 210 and 220, respectively. The sheet feed and separation devices 310 and 320 respectively include pick-up rollers 311 and 321 which are rotatable for paying out the uppermost sheets from the associated storing portions 210 and 220. A feed roller 312 and a reverse roller 313 are pressed against each other for separating the uppermost sheet from the underlying sheets. Likewise, a feed roller 322 and a reverse roller 323 are pressed against each other. Therefore, the devices 310 and 320 are so-called FRR type devices each comprising three rollers. The feed rollers 312 and 322 are each driven in the forward direction via a clutch, while the reverse rollers 313 and 323 are each driven in the reverse direction via a torque limiter. The devices 310 and 320 are identical in construction, and so are the relative positions of the rollers. If desired, the separating ability of the device 320 may be lowered, compared to that of the device 310. Specifically, as shown in FIG. 2B, the device 320 may be implemented by a friction pad type or similar simple device in place of the FRR type device.

Located at the right-hand side of the storing portions 210 and 220, respectively, the sheet feed and separation devices 310 and 320 feed the sheets to the right. While the two devices 310 and 320 adjoin each other serially in the direction of sheet feed, the rear device 320 is higher in level than the front device 310. Hence, the sheets of the storing portion 220 are paid out at a higher level than the sheets of the storing portion 210. The positional relation between the sheet stack of the front storing portion 210 and the front device 310 and the positional relation between the sheet stack of the rear storing portion 220 and the rear device 320 are identical due the above-stated relation between the devices 310 and 320 and the relation between the storing portions 210 and 220.

Figure 3:
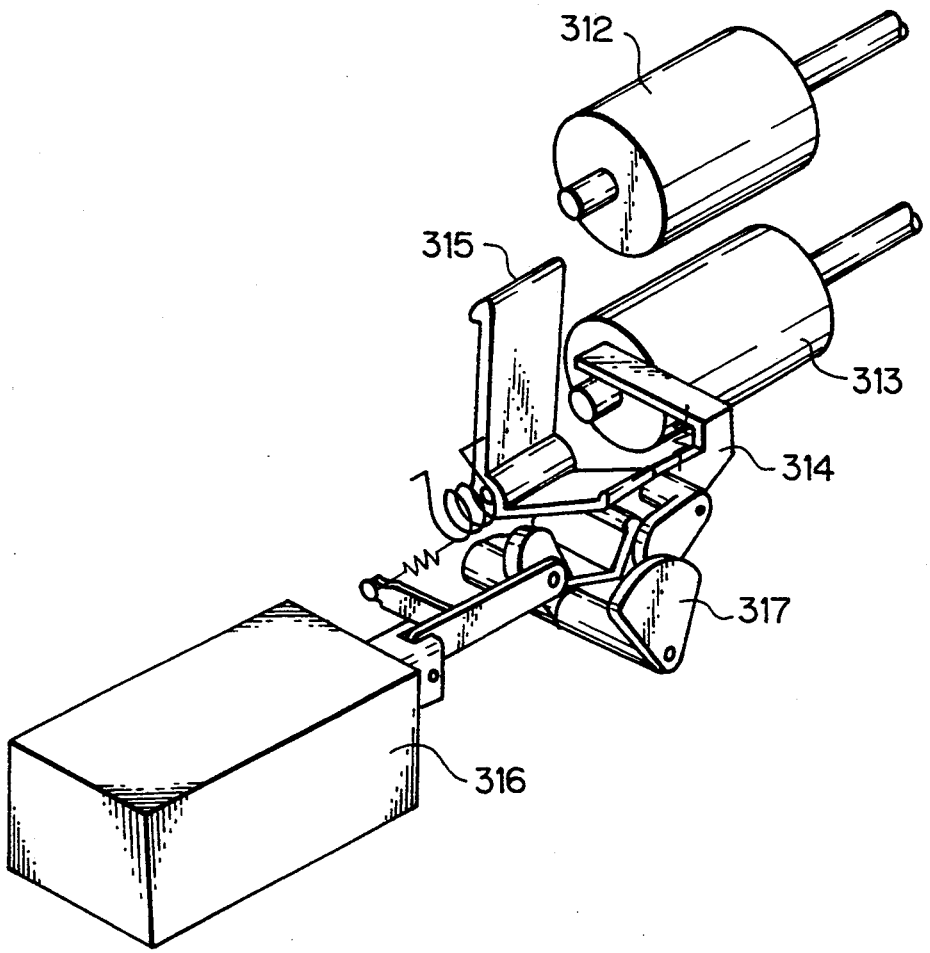
FIG. 3 is a perspective view of sheet returning means included in the embodiment.

As shown in FIG. 3, the sheet feed and separation device 310 has a lever 314 for cancelling a pressure, a lever 315 for returning the sheet, and a solenoid 316 for driving the levers 314 and 315. The lever 314 is supported in such a manner as to be rotatable to urge the shaft of the reverse roller 313 downward. Usually, the lever 314 is biased away from the shaft of the reverse roller 313 by a spring. The lever 315 has a rotary shaft parallel to the shafts of the feed roller 312 and reverse roller 313, and a lever portion slightly longer than the distance between the center of rotation of the rotary shaft and the nip portion of the rollers 312 and 313. Usually, the lever 314 is biased by a spring in such a direction that the lever portion is remote from the nip portion of the rollers 312 and 313 and hidden from the sheet transport plane. The solenoid 316 has a lever portion 317 which rotates the levers 314 and 315 against the action of the springs when the solenoid 316 is turned on.

As shown in FIG. 2A, the transport device 400 is interposed between the sheet feed and separation devices 310 and 320 and made up of roller pairs 410 and 420 adjoining the devices 310 and 320, respectively, and a guide 430. The transport device 400 is constructed into a unit independent of the sheet feeding and separating means 300. A sensor 440 is included in the transport device 400 for determining whether or not a sheet has passed or exists in the device 400. The roller pair 420 is located in the vicinity of and at substantially the same level as the feed roller 322 and reverse roller 323 of the device 320. The guide 430 extends substantially horizontally from the roller pair 420 to the roller pair 410. The roller pair 410 is located at the rear, i.e., upstream of the pick-up roller 311 in the direction of transport so as not to interfere with the operation of the device 310. The rollers of the roller pair 410 are made of sponge or similar material having a small coefficient of friction and are pressed against each other by a relatively low pressure. If desired, the rollers of the roller pair 410 may be selectively brought into or out of contact by, e.g., a pressure cancelling lever and a solenoid.

Figure 7A:
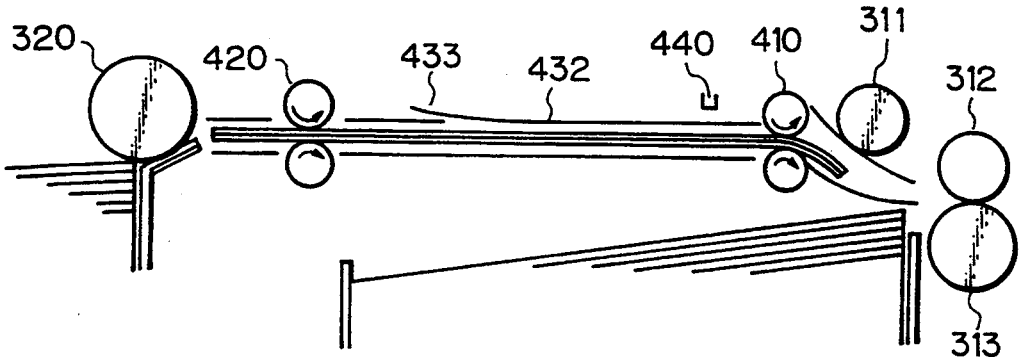
FIGS. 7A–7C also show an operation for feeding a sheet from the second sheet storing portion.
Figure 7B:
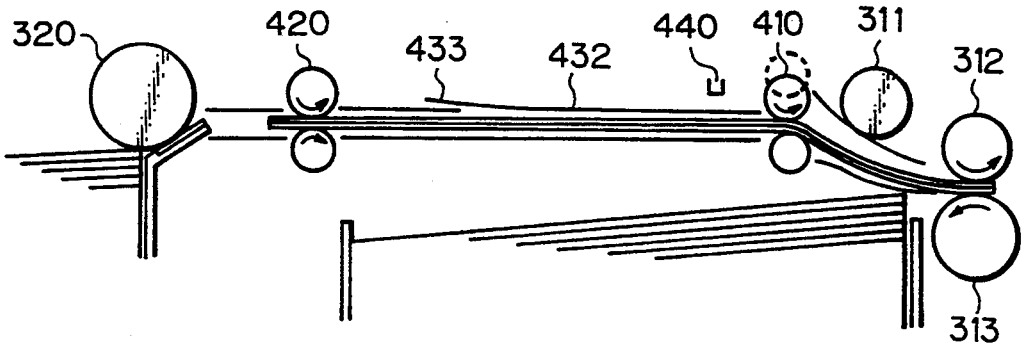
Figure 7C:
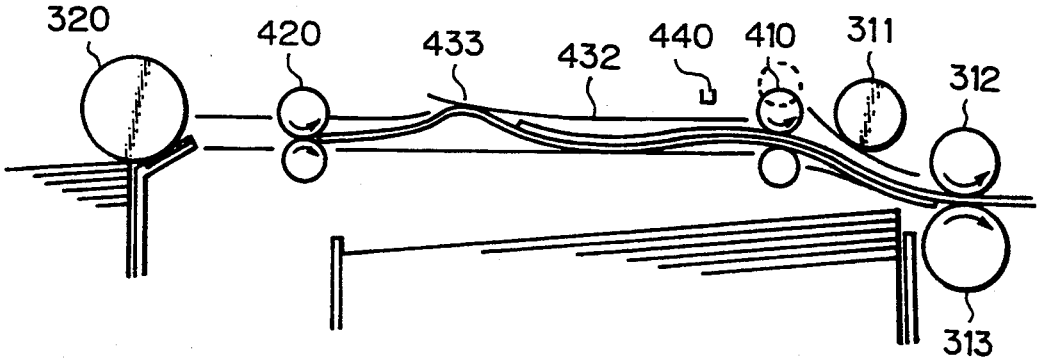

As shown in FIGS. 7A–7C, the guide 430 includes an upper guide 432 having a portion 433 which is made of Mylar or similar elastic material. This portion 433 absorbs a flexure occurred in a sheet.

The roller pairs 410 and 420 are driven via a clutch by the same drive source as the sheet feed and separation devices 310 and 320. Alternatively, the roller pairs 410 and 420 may be driven by an exclusive reversible motor.

The guide 430 is disposed above the sheet stack of the first storing portion 210 due to the previously stated stepped configuration of the tray 200 and the relation in level between the sheet feed and separation devices 310 and 320. The guide 430 is configured such that a sheet coming out of the roller pair 410 advances toward the feed roller 312 and reverse roller 313 of the device 310. Therefore, the transport device 400 is substantially entirely received in the extra space above the storing portion 210 derived from the difference in level between the storing portions 210 and 220, i.e., it is entirely received in the tray 200.

Figure 4A:
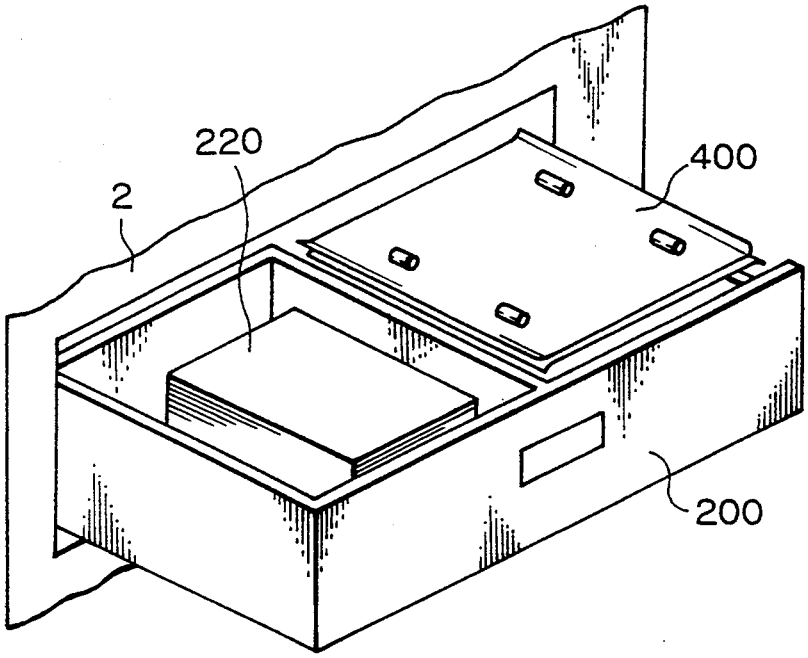
FIGS. 4A and 4B respectively show a tray included in the embodiment and the tray and a transport device also included in the embodiment, each in a positioned pulled out from the copier body.
Figure 4B:
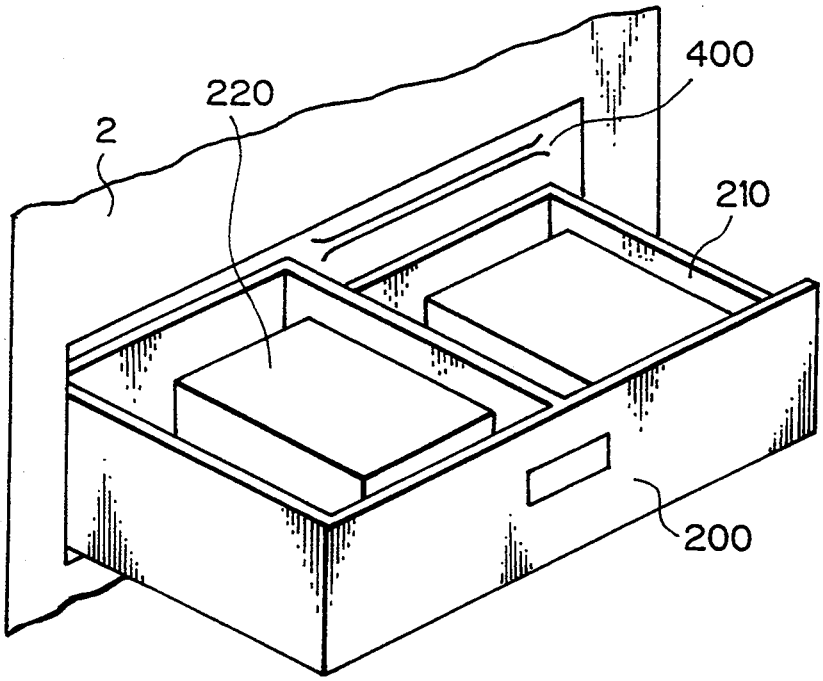

As shown in FIGS. 4A and 4B, the transport device 400 is constructed into a unit independent of the tray 200. The transport device 400 is mounted on the body of the sheet feed section 2 such that it can be pulled out substantially perpendicularly to the direction of sheet transport.

By constructing the tray 200, sheet feed and separation devices 310 and 320 and transport device 400 as described above, it is possible to store two stacks each having 250 to 500 sheets of particular size in the sheet feed device 100. In addition, the sheet feed device 100 is substantially the same size as the uppermost tray 20 accommodating sheets of large size, as measured in the widthwise and depthwise directions, and only slightly higher than an ordinary tray capable of storing 250 to 500 sheets. Further, since the transport device 400 is received in the tray 200, the sheet feed device 100 capable of feeding two different kinds of sheets is extremely compact, inclusive of the transport device 400.

The operation of the embodiment will be described on the assumption that the first and second storing portions 210 and 220 are loaded with sheets of B5 size and sheets of A4 size, respectively.

As shown in FIG. 4B, to supplement sheets, the tray 200 is pulled out toward the operator. At this instant, the transport device 400 is left in the sheet feeder body 2 since the device 400 is supported by the body 2 independently of the tray 200 and since the rear end of the tray 200 is notched. Therefore, when the tray 200 is pulled out, the top of the first storing portion 210 is also open and freely accessible. After sheets have been supplemented to the tray 200, the tray 200 is again pushed into the sheet feeder body 2. Then, levers **240*a* and 240*b*, FIG. 2A, raise the first and second bottom plates 230*a* and 230*b*, respectively. As a result, the sheets stacked in the storing portions 210 and 220 are pressed against the pick-up rollers 311 and 321, respectively. Assume that the operator has selected the sheets of B5 size on the copier body 1. Then, the pick-up roller 311 pays out the uppermost sheet of the storing portion 210 toward the feed roller 312 and reverse roller 313. The reverse roller 313 is driven in the reverse direction via a torque limiter. Hence, when only one sheet is paid out by the pick-up roller 311, the reverse roller 313 rotates in a direction for feeding the sheet, following the rotation of the feed roller 312. However, when two or more sheets are nipped by the feed roller 312 and reverse roller 313, the roller 313 rotates in a direction for returning the sheets so as to sequentially return the sheets other than the uppermost sheet to the storing portion 210, the lowermost sheet first. As a result, only one sheet is fed out by the feed roller 312 to the vertical transport path 10**.

Figure 5A:
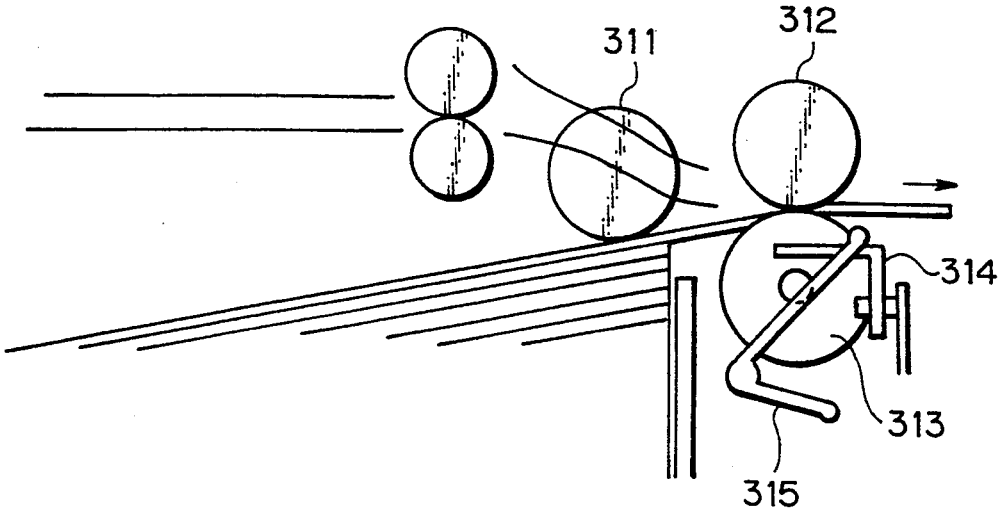
FIGS. 5A and 5B demonstrate how the sheet returning means returns a sheet.
Figure 5B:
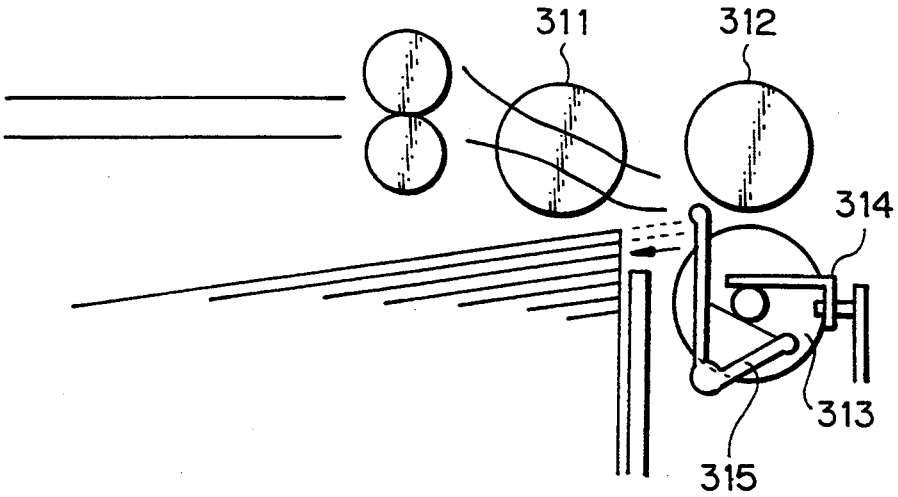
Figure 6A:
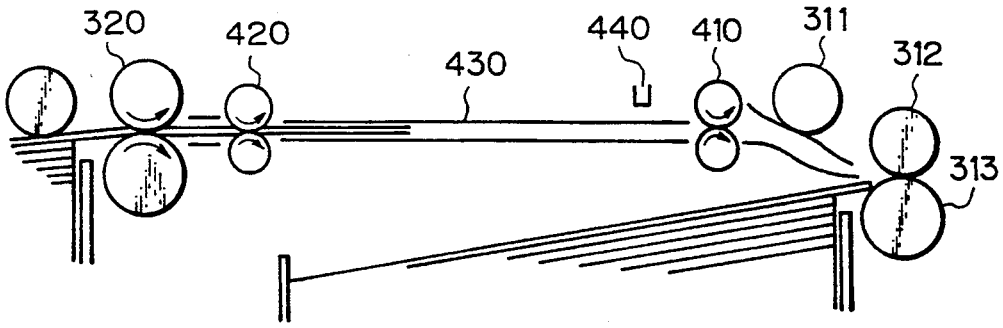
FIGS. 6A–6D show an operation of the embodiment for feeding a sheet from the second sheet storing portion.
Figure 6B:
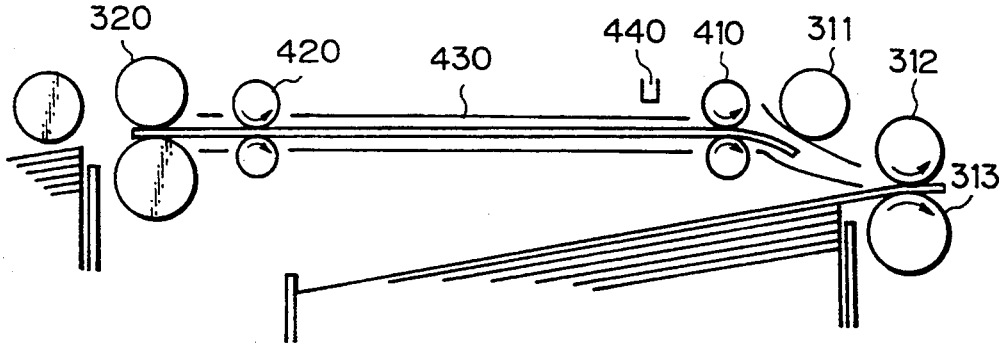
Figure 6C:
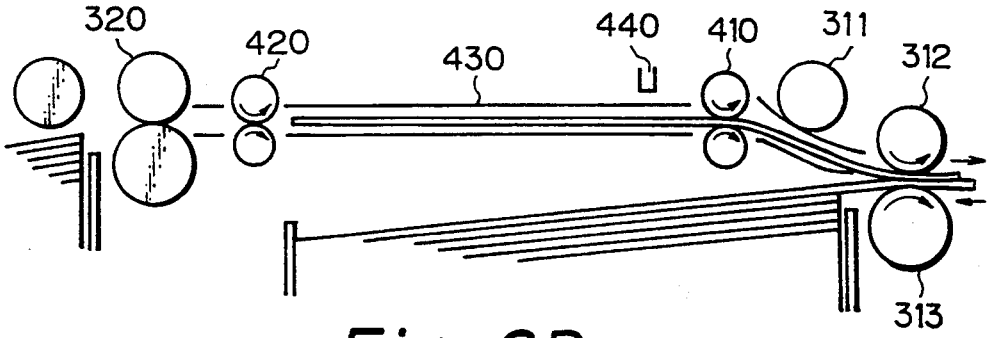
Figure 6D:
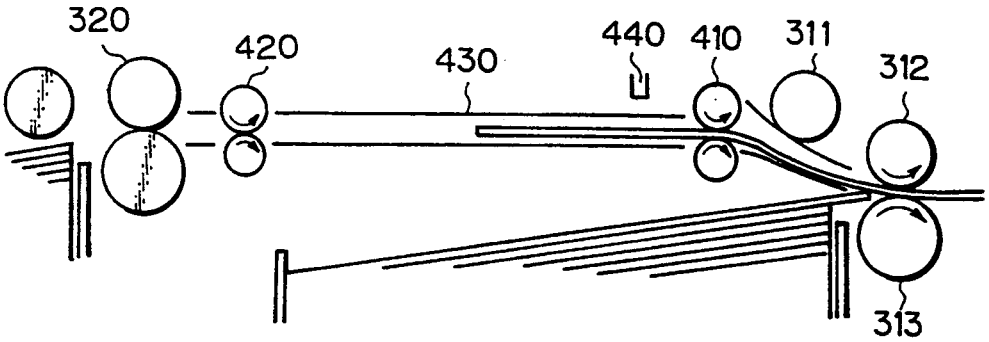

In the above condition, it may accidentally occur that the second sheet and successive sheets are also paid out to the vicinity of the nip portion of the feed roller 312 and reverse roller 313. In the light of this, after a series of sheet feed operations have been completed, the solenoid 316 is turned on to rotate the lever 314. As a result, the lever 314 urges the shaft of the reverse roller 313 downward to move the roller 313 away from the roller 312, as shown in FIG. 5B. Subsequently, the lever 315 is rotated to cause the lever portion thereof to pass the nip portion of the rollers 312 and 313 in the direction opposite to the sheet feed direction. Consequently, the lever portion of the lever 315 hits against the sheets remaining in the vicinity of the nip portion, thereby surely returning them to the storing portion 210, as also shown in FIG. 5B. When a plurality of sheets are continuously fed, such an operation is not effected every time a sheet is fed, but it effected after all the sheets have been fed.

On the other hand, when the sheets of A4 size are selected, the sheet feed and separation device 320 pays out only the uppermost sheet from the second storing portion 220. The sheet is driven along the guide 430 by the roller pair 420. Subsequently, the roller pair 410 transports the sheet to the nip portion of the feed roller 312 and reverse roller 313. These rollers 312 and 313 feed the sheet to the vertical transport path 10. At this instant, the drive timings of the sheet feed and separation device 320, transport device 400 and the sheet feed and separation device 310 are not coincident. After the sensor 440 included in the transport device 400 has sensed the leading edge of the sheet, the clutch associated with the sheet feed and separation device 310 is coupled on the elapse of a predetermined period of time, thereby driving the feed roller 312. The pick-up roller 311 is retracted to above the guide 430 so as not to obstruct the sheet being transported by the transport device 400. The sheet come out of the nip portion of the rollers 312 and 313 is routed through the vertical transport path 10 to the copier body 1. In this manner, the sheets paid out from both of the storing sections 210 and 220 are fed out to the vertical transport path 10 by way of the rollers 312 and 313. This means that only a single outlet from the sheet feed device 100 to the vertical transport path 10 suffices. Therefore, the outlet section from the device 100 to the path 10 can be configured in the same manner as that of a conventional front loading type sheet feeder and does not need a complicated construction. This is extremely advantageous from the transporting ability and cost standpoint.

When a sheet is to be fed from the storing portion 220 just after the feed of a sheet from the storing portion 210, a sheet left in the vicinity of the feed roller 312 has been fully returned to the storing portion 210, as stated earlier. Hence, sheets of the storing portion 210 are prevented from being fed out by accident. Assume that the feed roller 312 has accidentally paid out a sheet from the storing portion 210. Then, since the feed roller 312 is driven later than the sheet feed and separation device 320 and transport device 400, as stated previously, the sheet fed from the storing portion 220 by the device 320 is nipped by the feed roller 312 and reverse roller 313 just after the roller 312 has been driven, as shown in FIGS. 6A–6D. The roller pair 312 and 313, therefore, nips the two sheets immediately, and the roller 313 rotates in the reverse direction. As a result, while the sheet paid out from the storing section 220 and contacting the feed roller 312 is continuously fed, the sheet paid out from the storing section 210 and contacting the reverse roller 313 is returned to the storing portion 210 by the roller 313. This is successful in eliminating the accidental feed of unexpected sheets.

Assume that a plurality of sheets are paid out together from the storing portion 220 to the transport device 400 by the sheet feed and separation device 320. Then, as shown in FIGS. 7A–7C, such sheets are moved as far as the other sheet feed and separation device 310. When these sheets are separated by the device 310, a needless sheet is driven in the opposite direction by the reverse roller 313. At this instant, the sheet is returned to the transport device 400 while slipping on the roller pair 410, since the rollers of the roller pair 410 have a small coefficient of friction and lightly press against each other, as stated earlier.

Assume that a mechanism is provided for moving the rollers of the roller pair 410 toward and away from each other. Then, after a sensor, not shown, located downstream of the sheet feed and separation device 310 has sensed the sheet nipped by the device 310, the rollers of the roller pair 410 will be moved away from each other, as shown in FIGS. 7B and 7C. This allows the sheet driven in the opposite direction by the reverse roller 313 to be easily returned to the transport device 400. In the case where the sheet size is greater than the distance between the transport roller pairs 410 and 420, the sheet returned to the transport device 400 bends, as shown in FIG. 7C. However, the elastic portion 433 of the transport guide 432 successfully absorbs the flexure of the sheet to protect the sheet from damage.

When the sheet is returned to the transport device 400 as stated above, the sensor 440 senses it. As a result, it is determined that a sheet is present in the transport device 400. When sheets are to be continuously fed from the second storing portion 220, the sheet remaining in the transport device 400 is driven to the sheet feed and separation device 310 prior to the others. At this instant, the clutch associated with the sheet feed and separation device 320 is not coupled to prevent sheets from being paid out from the storing portion 220. This prevents many sheets from staying in the transport device 400. It may occur that a sheet remains in the transport device 400 after a single sheet has been fed out or a plurality of sheets have been fully fed out. In such a case, the sheet remaining in the transport device 400 is forcibly driven out of the sheet feed device 100 to prevent it from obstructing a sheet to be paid out from the storing portion 210 afterwards.

The roller pairs 410 and 420 may be implemented as reversible roller pairs. Then, when a sheet is left in the transport device 400 after the sheet feed from the second storing portion 220, the roller pairs 410 and 420 will be reversed to return it to the storing portion 220. In this case, it is not necessary to drive the sheet in the transport device 400 out of the sheet feed device 100.

Figure 8:
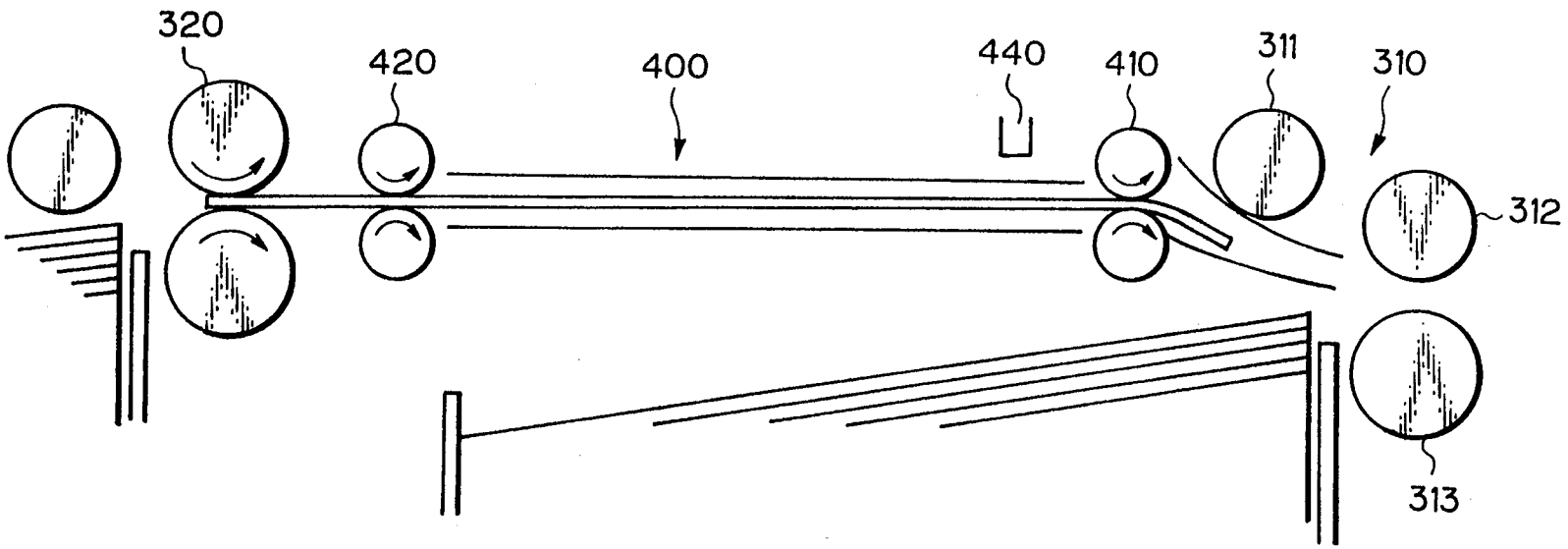
FIG. 8 is a view representative of a modified form of the embodiment.

When the sheet feed and separation device 320 is equivalent in performance to the sheet feed and separation device 310, it will rarely occur that a plurality of sheets are simultaneously brought from the second storing portion 220 to the transport device 400, separated by the device 310, and then left in the device 400. It follows that the construction and operation of the embodiment allows the performance of the device 320 to be lowered, compared to the device 310. Further, the device 320 can be implemented with, e.g., a friction pad system or similar simple system in place of the FRR system so as to simplify the construction and reduce the cost. Moreover, when the device 320 has a sufficient separating ability, the reverse roller 313 may be brought out of contact with the feed roller 312 to render the device 310 inoperative, as shown in FIG. 8. Then, no sheets will be left in the transport device 400, so that the mechanism and operation for removing such sheets are needless. On the other hand, even when a sheet is left in the transport device 400 due to a jam or similar cause, the operator can pull out the device 400 from the sheet feeder body 2 together with the tray 200 and readily remove the sheet.

While the embodiment uses a single tray having a first and a second storing portion, the tray may be implemented as a tray capable of accommodating, e.g., as great as 1,500 sheets and having a first and a second storing portion. In such a case, it is preferable that the first and second storing portions be constructed independently of each other, and that sheets from the two storing portions be fed independently of each other.

Figure 9:
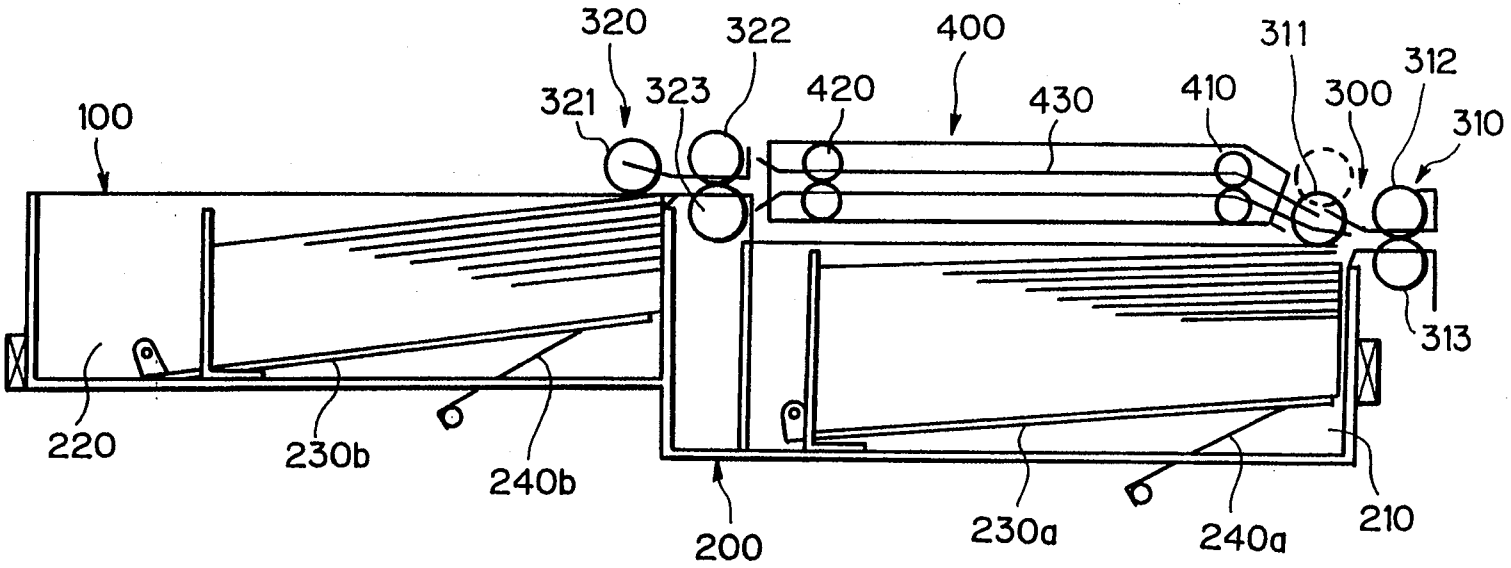
FIGS. 9–12 are views respectively showing a second to a fifth embodiment of the present invention.

Referring to FIG. 9, a second embodiment of the present invention will be described. This embodiment is identical with the first embodiment except for the constructions of the transport device 400 and sheet feed and separation device 310. In FIG. 9, the same or similar components as or to the components of the previous embodiment are designated by the same reference numerals, and a description thereof will not be made to avoid redundancy.

As shown in FIG. 9, the transport device 400 is interposed between the first and second sheet feed and separation devices 310 and 320 and made up of a first and a second roller pair 410 and 420 adjoining the devices 310 and 320, respectively, and a guide 430. The transport device 400 is constructed into a unit independent of the sheet feeding and separating means 300. The feed roller pair 420 is located in the vicinity of and at substantially the same level as the feed roller 320 and reverse roller 323 of the device 320. The guide 430 extends substantially horizontally from the roller pair 420 to the roller pair 410. The roller pair 410 is located at the rear, i.e., upstream of the pick-up roller of the device 310 so as not to interfere with the sheet feed from the storing portion 210. In the tray 200, the second storing portion 220 is positioned at a higher level than the first storing portion 210. Hence, the roller pairs 410 and 420 and guide 430 are disposed above the sheet stack of the storing portion 210.

The guide. 430 is configured such that a sheet coming out of the roller pair 410 is guided to the feed roller 312 and reverse roller 313 of the sheet feed and separation device 310. Therefore, the transport device 400 is substantially entirely received in the extra space above the storing portion 210 derived from the difference in level between the storing portions 210 and 220. The transport device 400 is mounted on the sheet feeder body 2 such that it can be pulled out perpendicularly to the direction of sheet transport independently of the tray 200.

By constructing the tray 200, sheet feed and separation devices 310 and 320 and transport device 400 as described above, it is possible to store two stacks each having 250 to 500 sheets of particular size in the sheet feed device 100. In addition, the sheet feed device 100 is substantially the same size as the uppermost tray 20 accommodating sheets of large size, as measured in the widthwise and depthwise directions, and only slightly higher than an ordinary tray capable of storing 250 to 500 sheets. Further, since the transport device 400 is received in the tray 200, the sheet feed device 100 capable of feeding two different kinds of sheets is extremely compact, inclusive of the transport device 400.

The operation of the second embodiment will be described on the assumption that the first and second storing portions 210 and 220 are loaded with sheets of A4 size and sheets of B5 size, respectively.

When the tray 200 is set in the sheet feed section 2, the levers **240*a* and 240*b* respectively urge the bottom plates 230*a* and 230*b* upward until the sheet stacks of the storing portions 210 and 220 abut against the pick-up rollers 311 and 321, respectively. When the sheets of A4 size are selected on the copier body 1, the pick-up roller 311 pays out the uppermost sheet from the storing portion 210 toward the nip portion of the feed roller 312 and 313. When two or more sheets are paid out together, the reverse roller 313 returns the sheets underlying the uppermost sheet. As a result, a single sheet is driven by the feed roller 312 toward the vertical transport path 10 which merges into the copier body 1. On the other hand, when the sheets of B5 size are selected, the sheet feed and separation device 320 feeds a single sheet from the storing portion 220. The sheet from the storing portion 220 is transported above the storing portion 210 along the guide 430 by the roller pair 420. Subsequently, this sheet is transported to the nip portion of the feed roller 312 and reverse roller 313 by the roller pair 410. At this instant, the pick-up roller 311 is retracted to above the guide 430 so as not to obstruct the transport of the sheet. The sheet comes out of the feed roller 312 and reverse roller 313 and is also delivered to the copier body 1 via the vertical transport path 10. In this manner, the sheets paid out from both of the storing portions 210 and 220 are fed out to the vertical transport path 10 via the feed roller 312 and reverse roller 313. Therefore, a single outlet from the second sheet feed stage 100 to the vertical transport path 10** suffices.

The feed roller 312 and reverse roller 313 may sequentially feed the sheets from the storing portion 210 one by one. In this case, it is likely that the sheets underlying the uppermost sheet are also paid out to the vicinity of the nip portion of the rollers 312 and 313. If a sheet is fed from the storing portion 220 in such a condition, the feed roller 312 and reverse roller 313 are apt to feed out the sheet positioned in the vicinity of their nip portion, or the sheet fed from the storing portion 220 by the transport device 400 is apt to contact the above-mentioned sheet to jam the path. In the light of this, after the feed of a sheet, the feed roller 312 is reversed for a predetermined period of time to return the sheet left in the nip portion to the storing portion 210, as has been conventional with an FRR sheet feeder. As shown in FIGS. 4A and 4B, when a sheet is left in the transport device 400 due to a jam or similar cause, the transport device 400 is pulled out of the sheet feed section 2 together with the tray 200. Then, the sheet left in the transport path 400 can be removed with ease.

Figure 10:
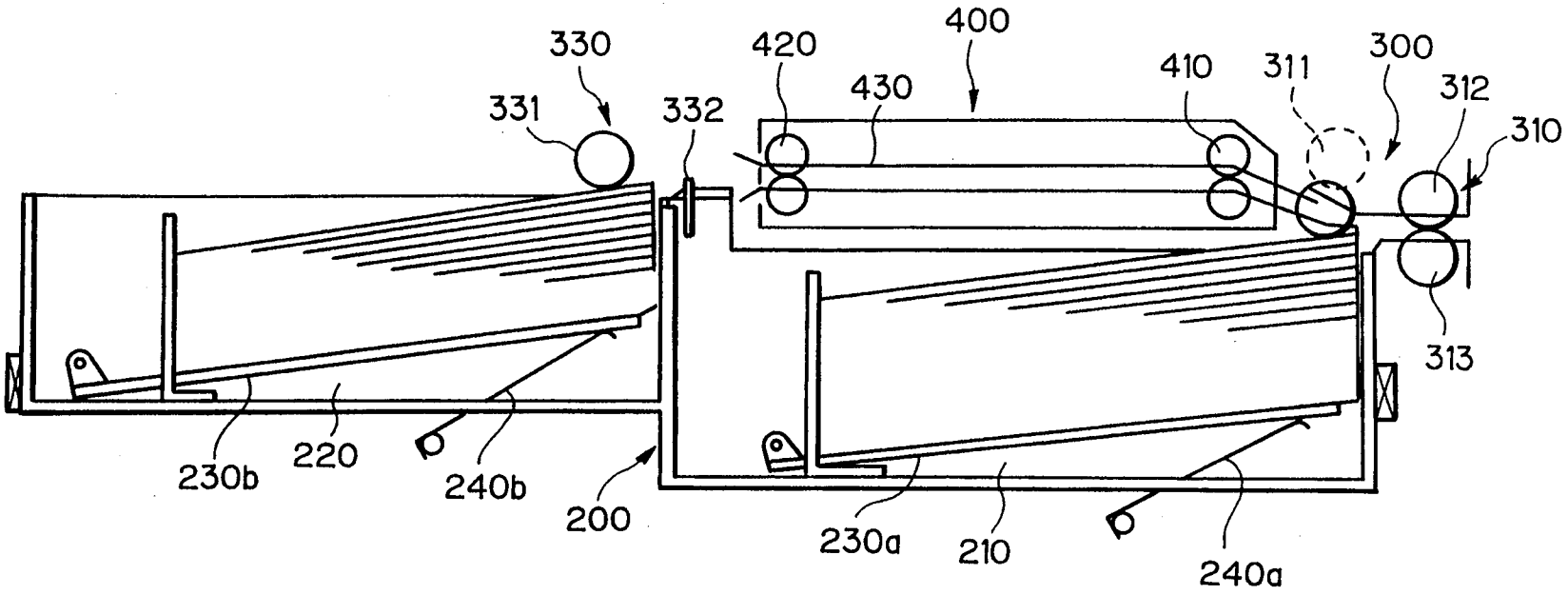

Referring to FIG. 10, a third embodiment of the present invention is shown which is essentially similar to the second embodiment except that it has a simple pay-out device 330 in place of the second sheet feed and separation device 320. The pay-out device 330 consists of a feed roller 331 and a separating plate 332. When the uppermost sheet is paid out from the storing portion 220 by the feed roller 331, the separating plate 332 separates it from the others to a certain degree. However, the plate 332 cannot full y separate the uppermost sheet from the others and sometimes causes two or more sheets to be introduced into transport device 400 at the same time. Even in such a condition, the sheets are driven to the sheet feed and separation device 310 via the transport device 400, and only the uppermost sheet is separated from the others by the feed roller 312 and reverse roller 313. Further, when a sheet is left in the transport device 400, a sensor, not shown, (corresponding to the sensor 440, FIGS. 2A and 2B) senses it. Then, when sheets are to be fed from the storing portion 220, the sheet left in the transport device 400 is fed out first.

Figure 11:
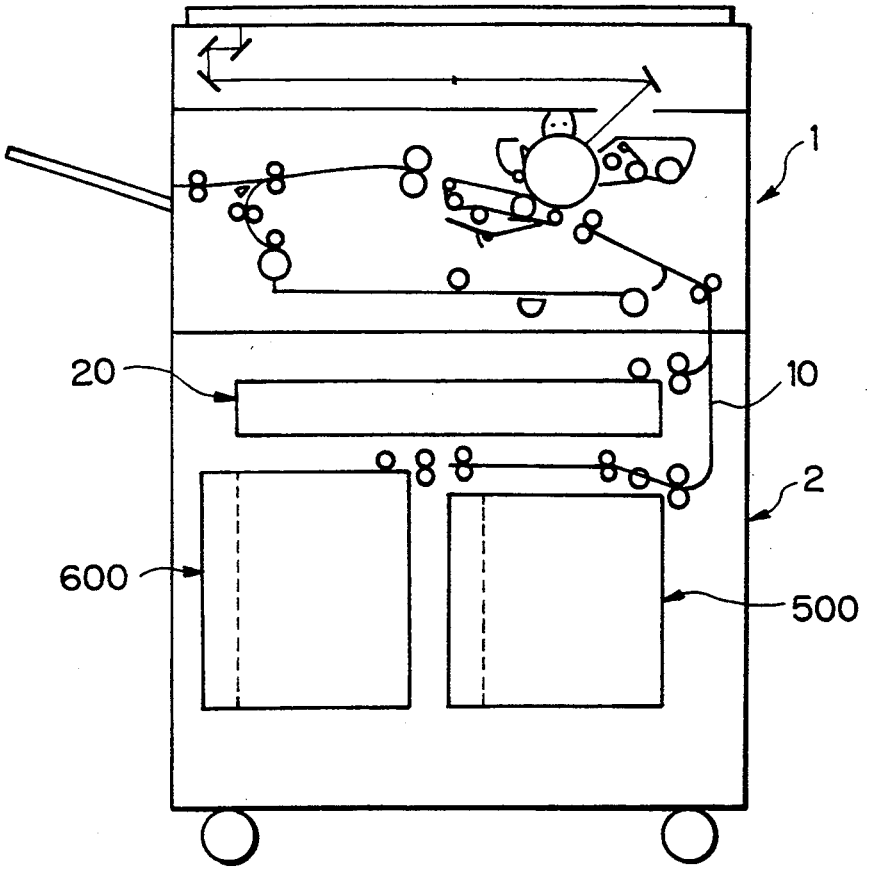

FIG. 11 shows a fourth embodiment of the present invention having large capacity trays (LCT) 500 and 600 in place of the tray 200. Implementing the first and second storing sections, respectively, the trays 500 and 600 are each capable of accommodating about 2,000 sheets. The trays 500 and 600 are constructed independently of each other and can be pulled out independently of each other. The tray 600 is capable of accommodating a greater number of sheets than the tray 500. Specifically, the sheet feed position of the tray 600 is higher in level than that of the tray 500. As a result, the sheet feed and separation devices 310 and 320 associated with the trays 500 and 600, respectively, and the transport device 400 are arranged in the same manner as in the previous embodiments. In this configuration, the two large capacity trays 500 and 600 can be readily accommodated in the conventional front loading type sheet feeder without resorting to a complicated path arrangement.

Figure 12:
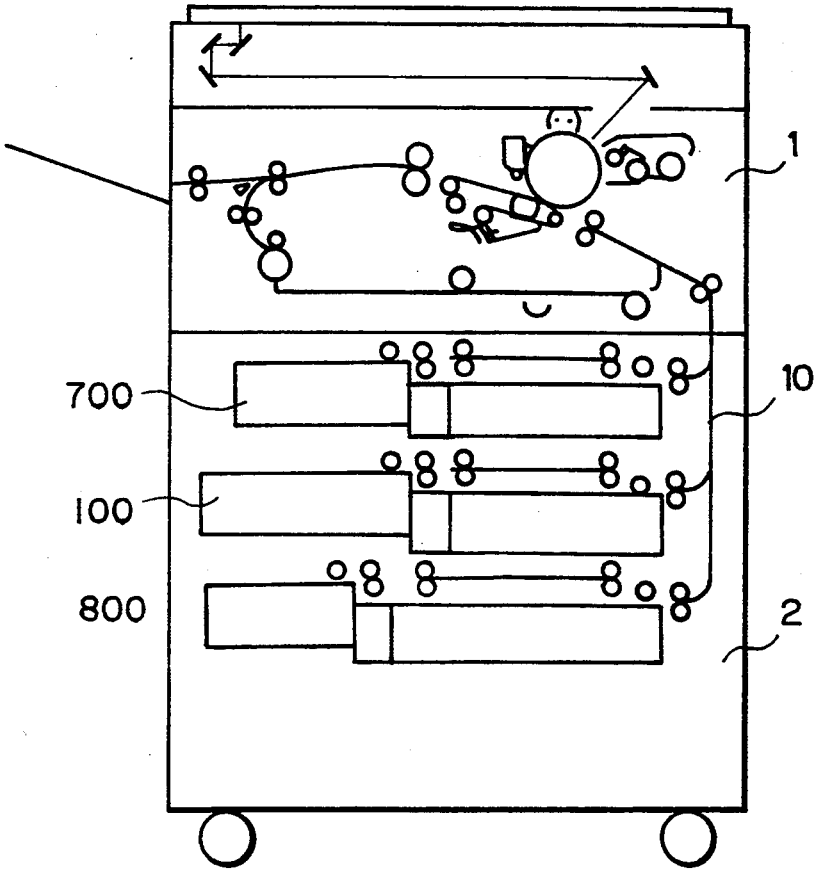

FIG. 12 shows a fifth embodiment where each of the feed stages 100, 700, and 800 have two storing portions arranged serially in the intended direction of sheet transport. The feeding, separating, and transporting of sheets along feed stages 700 and 800 are the same as those discussed previously with respect to feed stage 100.

All the embodiments shown and described use FRP type sheet feed and separation devices as the sheet feeding and separating means, any other suitable type of sheet feed and separating means may be used. The feed roller pairs 410 and 420 and guide 430 of the transport device 400 may, of course, be replaced with a belt or similar transporting means.

In summary, it will be seen that the present invention provides a sheet feed device having various unprecedented advantages, as enumerated below.

(1) Sheets paid out from a plurality of storing portions, which adjoin each other serially, are separated by separating means located downstream of the storing portions with respect to a direction of sheet transport. Hence, the sheets from the storing portions share the separating means. This, coupled with the fact that the separating means is followed by a single transport path, reduces the size and simplifies the construction of the device.

(2) Separating means is associated with each of the storing portions. Hence, a sheet is surely fed from each storing portion while being separated from the other sheets. All the sheets from the storing portions are brought to common feeding means located downstream of the storing portions. Hence, the sheets share a common transport path following the feeding means, thereby implementing a simple and miniature sheet feed device.

(3) There is provided a sheet feed stage including two of the plurality of storing portions arranged one above the other. This sheet feed stage is provided with a single transport path. It follows that a greater number of sheets can be stored in the sheet feed device without scaling up the arrangement. Further, since the sheet feed stage having two storing portions can be handled in the same manner as a sheet feed stage implemented as a single storing portion, the capacity of the sheet feed device can be increased without complicating the construction. This is especially true with a front loading type sheet feed device.

(4) A sheet does not have to be transported from the upstream side by overcoming gravity. This simplifies transporting means and reduces the size of the sheet feed device.

(5) At least two storing portions are implemented as a single tray. Transporting means is provided independently of the tray for transporting a sheet paid out from upstream one of the storing portions. The tray and the transporting means can be handled independently of each other. This promotes easy supplement of sheets to the storing portions and easy removal of jamming sheets.

(6) The sheet feeding means associated with a downward storing portion is positioned at a lower level than the sheet feeding means associated with an upstream storing portion. Hence, the downstream storing portion is lower in level than the upstream storing portion. The transporting means is associated with the lower storing means. This is also successful in reducing the size of the sheet feed device.

(7) Even when a sheet is fed from a second storing portion after the feed of a sheet from a first storing portion, returning means included in the sheet feeding and separating means which is associated with the first storing portion returns the needless sheet. This prevents a sheet from being paid out from the first storing portion by accident. It follows that sheets can be surely fed from each storing portion one by one, thereby enhancing reliable operation of the sheet feeder.

(8) Since first sheet feeding and separating means includes returning means, it is possible to provide second sheet feeding and separating means with a lower separating ability than the first means. This simplifies the construction of the second means and reduces the size and cost of the sheet feed device.

(9) A sheet separated by first sheet feeding and separating means and left in the vicinity of the same is returned at the end of sheet feed. Hence, not only wasteful sheet transport is eliminated, but also the sheet feed speed is increased. In addition, sheet jams are eliminated to enhance reliable sheet feed.

(10) A sheet from a second storing portion is transported prior to a sheet from a first storing portion without exception. This prevents sheets from the first and second storing portions from being fed together to jam the path, further enhancing the reliability of sheet feed.

(11) When returning means returns a sheet paid out together with the uppermost sheet, the sheet is surely returned by slipping on a first transport roller or through between the rollers of a first transport roller pair.

(12) A sheet fed from the second storing portion and separated by the first sheet feeding and separating means can be temporarily held due to the flexure of the sheet. Hence, sheets can be surely fed from the second storing portion one by one without jamming the path.

(13) A sheet separated by the first sheet feeding and separating means and left in the transporting means can be returned to the second storing portion after the sheet feeding operation. This prevents sheets from being wastefully fed out.

(14) When a sheet is present in the transporting means in the event of continuous sheet feed, it is fed out first. This is successful in preventing many sheets from staying in the transporting means; otherwise, such sheets would obstruct the sheet feed from the first storing portion. Hence, the sheet feed device is operable with reliability.

(15) When a sheet is present in the transporting means after the sheet feeding operation, it is forcibly driven out of the transporting means. This also enhances reliable operations.

(16) Sheets fed from the second storing portion are surely separated by the second sheet feeding and separating means one by one, i.e., they do not have to be returned by the returning means. This simplifies the configuration of the transporting means, prevents a sheet from remaining in the transporting means, and reduces the cost of the sheet feeder.

Various modifications will become possible for those skilled in the art after receiving the teachings of the present disclosure without departing from the scope thereof.

What is claimed is:

1. A sheet feed device comprising:

a first storing portion positioned substantially horizontally and having a front and a rear with respect to an intended direction of sheet pay-out;

first sheet feeding and separating means for paying out sheets from said first storing portion while separating said sheets one by one, and including returning means for returning a needless sheet in a direction opposite to an intended direction of sheet pay-out;

a substantially horizontal second storing portion serially adjoining and located at the rear of said first storing portion with respect to said intended direction of sheet pay-out;

second sheet feeding and separating means for paying out sheets from said second storing portion one by one in the same direction as said intended direction of pay-out; and transporting means for guiding the sheets paid out from said second sheet feeding and separating means to said first sheet feeding and separating means;

wherein said second sheet feeding and separating means has a lower separating ability than said first sheet feeding and separating means.

2. A sheet feed device comprising:

a first storing portion positioned substantially horizontally and having a front and a rear with respect to an intended direction of sheet pay-out;

first sheet feeding and separating means for paying out sheets from said first storing portion while separating said sheets one by one, and including returning means for returning a needless sheet in a direction opposite to an intended direction of sheet pay-out;

a substantially horizontal second storing portion serially adjoining and located at the rear of said first storing portion with respect to said intended direction of sheet pay-out;

second sheet feeding and separating means for paying out sheets from said second storing portion one by one in the same direction as said intended direction of pay-out; and transporting means for guiding the sheets paid out from said second sheet feeding and separating means to said first sheet feeding and separating means;

wherein when the sheet is paid out from said second storing portion, said first sheet feeding and separating means is driven later than said second sheet feeding and separating means and said transporting means.

3. A sheet feed device comprising:

a first storing portion positioned substantially horizontally and having a front and a rear with respect to an intended direction of sheet pay-out;

first sheet feeding and separating means for paying out sheets from said first storing portion while separating said sheets one by one, and including returning means for returning a needless sheet in a direction opposite to an intended direction of sheet pay-out;

a substantially horizontal second storing portion serially adjoining and located at the rear of said first storing portion with respect to said intended direction of sheet pay-out;

second sheet feeding and separating means for paying out sheets from said second storing portion one by one in the same direction as said intended direction of pay-out; and transporting means for guiding the sheets paid out from said second sheet feeding and separating means to said first sheet feeding and separating means;

wherein said transporting means comprises:

a first roller pair located upstream of said first sheet feeding and separating means with respect to an intended direction of sheet transport;

a second roller pair located upstream of said first roller pair and downstream of said second sheet feeding and separating means with respect to said intended direction of sheet transport; and a guide extending at least between said first and second roller pairs;

said first roller pair being made of a material having a relatively small coefficient of friction to allow the sheet to slip thereon.

4. A sheet feed device comprising:

a first storing portion positioned substantially horizontally and having a front and a rear with respect to an intended direction of sheet pay-out;

first sheet feeding and separating means for paying out sheets from said first storing portion while separating said sheets one by one, and including returning means for returning a needless sheet in a direction opposite to an intended direction of sheet pay-out;

a substantially horizontal second storing portion serially adjoining and located at the rear of said first storing portion with respect to said intended direction of sheet pay-out;

second sheet feeding and separating means for paying out sheets from said second storing portion one by one in the same direction as said intended direction of pay-out; and transporting means for guiding the sheets paid out from said second sheet feeding and separating means to said first sheet feeding and separating means;

wherein said transporting means comprises:

a first roller pair located upstream of said first sheet feeding and separating means with respect to an intended direction of sheet transport;

a second roller pair located upstream of said first roller pair and downstream of said second sheet feeding and separating means with respect to said intended direction of sheet transport; and a guide extending at least between said first and second roller pairs;

said first roller pair comprising rollers which are movable into and out of contact with each other.

5. A device as claimed in claim 4, wherein part of said guide of said transporting means is made of an elastic material deformable in complementary relation to a flexure of the sheet.

6. A sheet feed device comprising:

a first storing portion positioned substantially horizontally and having a front and a rear with respect to an intended direction of sheet pay-out;

first sheet feeding and separating means for paying out sheets from said first storing portion while separating said sheets one by one, and including returning means for returning a needless sheet in a direction opposite to an intended direction of sheet pay-out;

a substantially horizontal second storing portion serially adjoining and located at the rear of said first storing portion with respect to said intended direction of sheet pay-out;

second sheet feeding and separating means for paying out sheets from said second storing portion one by one in the same direction as said intended direction of pay-out; and transporting means for guiding the sheets paid out from said second sheet feeding and separating means to said first sheet feeding and separating means;

wherein said transporting means comprises:

a first roller pair located upstream of said first sheet feeding and separating means with respect to an intended direction of sheet transport;

a second roller pair located upstream of said first roller pair and downstream of said second sheet feeding and separating means with respect to said intended direction of sheet transport; and a guide extending at least between said first and second roller pairs; and drive means for reversibly driving said first and second roller pairs.

7. A sheet feed device comprising:

a first storing portion positioned substantially horizontally and having a front and a rear with respect to an intended direction of sheet pay-out;

first sheet feeding and separating means for paying out sheets from said first storing portion while separating said sheets one by one, and including returning means for returning a needless sheet in a direction opposite to an intended direction of sheet pay-out;

a substantially horizontal second storing portion serially adjoining and located at the rear of said first storing portion with respect to said intended direction of sheet pay-out;

second sheet feeding and separating means for paying out sheets from said second storing portion one by one in the same direction as said intended direction of pay-out; and transporting means for guiding the sheets paid out from said second sheet feeding and separating means to said first sheet feeding and separating means;

wherein said transporting means comprises sensing means for sensing a sheet present in said transporting means, said second sheet feeding and separating means being prevented from paying out a sheet when a sheet is present in said transporting means after a sheet feed from said second storing means as determined by said sensing means.

8. A sheet feed device comprising:

a first storing portion positioned substantially horizontally and having a front and a rear with respect to an intended direction of sheet pay-out;

first sheet feeding and separating means for paying out sheets from said first storing portion while separating said sheets one by one, and including returning means for returning a needless sheet in a direction opposite to an intended direction of sheet pay-out;

a substantially horizontal second storing portion serially adjoining and located at the rear of said first storing portion with respect to said intended direction of sheet pay-out;

second sheet feeding and separating means for paying out sheets from said second storing portion one by one in the same direction as said intended direction of pay-out; and transporting means for guiding the sheets paid out from said second sheet feeding and separating means to said first sheet feeding and separating means;

wherein said transporting means comprises sensing means for sensing a sheet present in said transporting means, said device driving, when a sheet is present in said transporting means after a sheet feed from said second storing means as determined by said sensing means, said sheet out of said transporting means.

9. A sheet feed device comprising:

a first storing portion positioned substantially horizontally and having a front and a rear with respect to an intended direction of sheet pay-out;

first sheet feeding and separating means for paying out sheets from said first storing portion while separating said sheets one by one, and including returning means for returning a needless sheet in a direction opposite to an intended direction of sheet pay-out;

a substantially horizontal second storing portion serially adjoining and located at the rear of said first storing portion with respect to said intended direction of sheet pay-out;

second sheet feeding and separating means for paying out sheets from said second storing portion one by one in the same direction as said intended direction of pay-out; and transporting means for guiding the sheets paid out from said second sheet feeding and separating means to said first sheet feeding and separating means;

wherein when a sheet is paid out from said second storing portion, said first sheet feeding and separating means is moved away from the intended path of travel of the paid out sheets and thereby prevented from performing a separating operation.

10. A sheet feed device comprising:

a plurality of storing portions arranged serially in an intended direction of sheet transport, each being adapted to be loaded with a stack of sheets;

first feeding means associated with a downstream one of said plurality of storing portions for feeding sheets loaded in said downstream one of said plurality of storing portions;

first separating means located downstream, in said direction of sheet transport, of said first feeding means for separating the sheets fed from said plurality of storing portions; and second feeding means associated with an upstream one of said plurality of storing portions for feeding sheets loaded in said upstream one of said plurality of storing portions;

transporting means disposed above said downstream one of said plurality of storing portions and between said second feeding means and said first separating means, for transporting the sheets fed by said second feeding means to said first separating means;

wherein said transporting means is movable perpendicularly to said intended direction of sheet transport for easy removal of an unneeded sheet therefrom.

11. A sheet feed device comprising:

a plurality of storing portions constituted by a plurality of sheet feed stages arranged one above the other said plurality of sheet feed stages each comprising two storing portions arranged serially in an intended direction of sheet transport;

an upstream feeding means On each feed stage associated with the upstream storing portion on the same feed stage for feeding sheets loaded in the associated upstream storing portion;

a downstream feeding means on each feed stage associated with the downstream storing portion on the same feed stage for feeding sheets loaded on the associated downstream storing portion;

separating means associated with each of said feeding means for separating said sheets one by one;

a common transport path connected to said plurality of sheet feed stages for transporting sheets selectively paid out from said plurality of storing portions in the same direction to a predetermined position downstream of said common transport path with respect to said intended direction of sheet transport;

a plurality of transport paths each being associated with a respective one of said plurality of sheet feed stages for transporting sheets paid out from said two storing portions of the sheet feed stage; and a plurality of transporting means each associated with a respective one of said plurality of sheet feed stages and disposed above the downstream one of said two storing portions and between the separating means associated with the upstream feeding means and the separating means associated with the downstream feeding means for transporting sheets from the separating means associated with the upstream feeding means through the separating means associated with the downstream feeding means to said common transport path;

wherein said transporting means is movable perpendicularly to said intended direction of sheet transport for easy removal of an unneeded sheet therefrom.

* * * * *